US008656523B2

(12) United States Patent
Vaniakin

(10) Patent No.: US 8,656,523 B2
(45) Date of Patent: Feb. 25, 2014

(54) DISPOSABLE PROTECTIVE TOILET SEAT COVER

(76) Inventor: Val Vaniakin, Henrico, VA (US)

( * ) Notice: Subject to any disclaimer, the term of this patent is extended or adjusted under 35 U.S.C. 154(b) by 365 days.

(21) Appl. No.: 13/035,267

(22) Filed: Feb. 25, 2011

(65) Prior Publication Data

US 2012/0216342 A1 Aug. 30, 2012

(51) Int. Cl.
*A47K 13/24* (2006.01)
*A47K 13/00* (2006.01)

(52) U.S. Cl.
CPC ..... *A47K 13/00* (2013.01)
USPC ..... 4/245.3

(58) Field of Classification Search
CPC ..... A47K 13/00
USPC ..... 4/245.1–245.9
See application file for complete search history.

(56) References Cited

U.S. PATENT DOCUMENTS 3,753,262 A * 8/1973 Watsky ..... 4/244.2
4,850,061 A * 7/1989 Engel ..... 4/245.4
4,979,237 A * 12/1990 Hazar et al. ..... 4/244.1
5,437,906 A * 8/1995 Snuggs ..... 428/131
5,551,096 A * 9/1996 Gardner ..... 4/245.4
5,557,809 A * 9/1996 Adams ..... 4/245.3
6,996,859 B1 * 2/2006 Alonso et al. ..... 4/245.1
7,328,465 B1 * 2/2008 Morad ..... 4/245.3
7,707,661 B2 * 5/2010 Issachar ..... 4/245.1
7,774,869 B2 * 8/2010 Massey, Jr. ..... 4/245.1
7,854,028 B1 * 12/2010 Williams ..... 4/245.6
2003/0208836 A1 * 11/2003 Bankemper ..... 4/245.1
2007/0044214 A1 * 3/2007 Bordas ..... 4/244.3
2007/0124854 A1 * 6/2007 Spratt et al. ..... 4/245.6
2009/0217449 A1 * 9/2009 Heath ..... 4/449

* cited by examiner

*Primary Examiner* — Lori Baker

(74) *Attorney, Agent, or Firm* — Goodman, Allen & Filetti PLLC; Matthew R. Osenga

(57) ABSTRACT

A disposable, biodegradable toilet seat cover is described. The toilet seat cover is formed of two or more layers including a top layer formed of a cold water soluble film, such as PVA, and a base layer formed of a tissue paper, such as toilet paper. The layers are held together by a water-soluble adhesive or glue. In use, the base layer absorbs moisture from the toilet seat and the top layer keeps the moisture away from the user. The top layer dissolves in cold water and the base layer decomposes in the plumbing system.

14 Claims, 3 Drawing Sheets

DISPOSABLE PROTECTIVE TOILET SEAT COVER

FIELD OF THE INVENTION

The invention relates generally to toilet seat covers, and more particularly to a disposable, water-soluble protective toilet seat cover.

BACKGROUND OF THE INVENTION

Public restrooms and toilets are often not kept clean and sanitary as one would like. This is particularly true of the toilets and toilet seats that must be used by multiple persons. The toilet seats may be soiled or wet and may contain disease-causing bacteria and viruses.

The user of such a toilet generally has no choice but to use such facilities. The user may attempt to wipe the seat with toilet paper or other tissue. A user may use toilet paper from the dispenser to cover the seat to provide a barrier between the user and the seat. This usually provides unsatisfactory results because the toilet paper has a tendency to move during use and moisture from the seat may soak through to the skin of the user. The use of toilet paper on the seat does not solve the problem of wet or dirty toilet seats.

Some restrooms have paper toilet seat covers that may be used on the toilet seat. These covers are made of paper and are shaped to fit the shape of the seat. After use, the paper is flushed down the toilet. Similar to the use of toilet paper, however, the paper has a tendency to slide over the surface of the seat and not stay in place. In addition, moisture may soak through the paper to the skin of the user. To prevent this, some seat covers are oversized to drape down the sides of the toilet bowl; others recommend taping the cover to the toilet seat. Thus, paper seat covers do not provide satisfactory results of keeping the user clean and dry when using a public toilet.

On the other end of the spectrum is a motorized seat cover that utilizes a sensor or a push button to change the toilet seat cover for the next user. A roll of plastic tubing is placed on the left side of the seat. This sanitary plastic tubing encases the toilet seat ring and then feeds into the toilet seat housing. After each use, the plastic is split by an internal razor blade and then rewound on the right side of the toilet seat housing. This used plastic is automatically spooled on the other side of the seat for disposal. Systems of this type are expensive and require cleaning personnel to dispose of the used plastic after it is rewound from the seat.

Another option, especially for travelers, is a hard plastic cover that may be molded to fit standard toilet seats. The user can bring the seat along for use in public toilets to avoid having to sit directly on the toilet seat. When finished, the user simply takes the seat along to the next use. These seats can be heavy, especially for children, and can take up a lot of space when traveling. They also require the user to clean them when finished so as not to bring the very moisture and germs along that he was hoping to avoid.

It would be advantageous to have a disposable, water-soluble toilet seat cover that can be easily placed over a toilet seat and will stay in place during use. For example, it would be advantageous for the cover to be dissolvable in water or be flushable within the toilet. It is desirable that the cover include a portion that absorbs moisture on the toilet seat and a portion that is impermeable to moisture that forms a barrier between the user and the toilet seat.

SUMMARY OF THE INVENTION

The invention provides various exemplary embodiments, including devices that can be implemented as disposable, water-soluble toilet seat covers.

These and other features and advantages of exemplary embodiments of the invention are described below with reference to the accompanying drawings.

DETAILED DESCRIPTION

In the following description, a number of materials are identified as suitable for various facets of the implementations. These materials are to be treated as exemplary and are not intended to limit the scope of the claims.

The general term "toilet seat cover" is used herein to refer to any type of device, article, or apparatus that may be placed onto the seat or ring of a toilet and that is intended for a person using the toilet to sit upon.

An article may be referred to as "disposable" meaning that it is easily discarded or thrown away and is not intended for multiple uses. Thus, an article formed of hard, molded plastic or similar material would not be considered disposable. An article may be referred to as "biodegradable" meaning that it is easily broken down chemically by the environment. Finally, a substance or article may be referred to as "water-soluble" meaning that it is partially, substantially, or completely dissolvable in water.

The material "tissue paper" refers to a thin, soft paper. Examples of tissue paper include that used for toilet paper, facial tissue, paper towels, and disposable napkins. Materials used in each of these examples are intended to be encompassed by the term "tissue paper."

Figure 1:
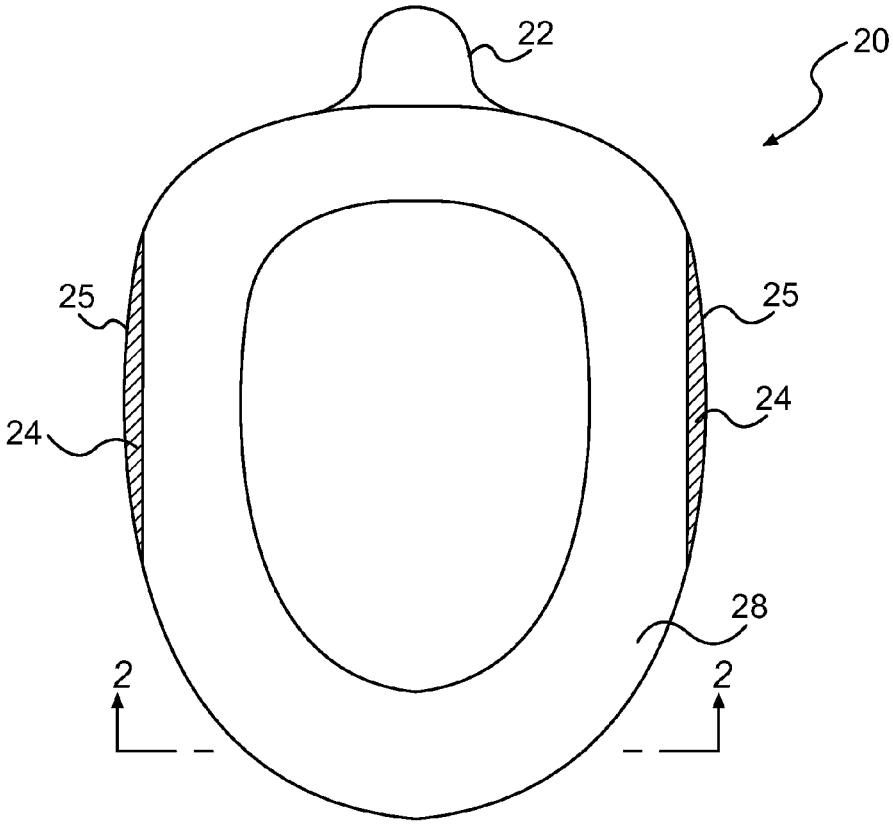
FIG. 1 is a bottom view of a toilet seat cover.

FIG. 1 shows toilet seat cover 20 that can be implemented in a number of different ways. Seat cover 20 is shown in FIG. 1 as having an oval shape, but the shape is not limited. Seat cover 20 can be shaped to fit any toilet seat or ring shape including oval, round, elongated, or other shapes.

The implementation shown in FIG. 1 includes a tab 22 that can be easily grasped by a user to separate seat cover 20 from other seat covers, such as from a box or dispenser. Such a tab is not strictly necessary, but can aid in use. Tab 22 could be made from water-dissolving polyvinyl alcohol (PVA), or other plastic, paper, or similar material, but will typically be made of water-dissolving PVA to prevent it from ripping or pulling away from seat cover 20 when pulled by the user.

Figure 2:
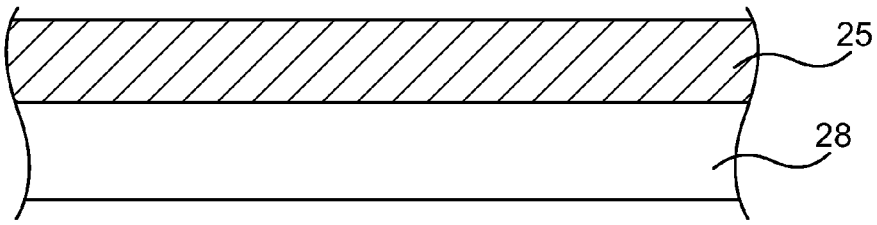
FIG. 2 is a cross-sectional view of the toilet seat cover taken along line 2-2 of FIG. 1.

Seat cover 20 is formed of two or more layers, as shown in FIG. 2. Top layer 25 is formed of a cold water soluble film or plastic material, such as polyvinyl alcohol (PVA). Top layer 25 could also be formed of water-dissolving fabrics, such as Fabri-Solvy fabric available from eQuilter.com of Boulder, Colo. or Sulky® Fabri-Solvy™ fabric that contains a stabilizer, commercially available from Sulky of American of Kennesaw, Ga. Top layer 25 may also include a water-soluble film as described below. Base layer 28 is formed of a biodegradable material such as tissue paper that is currently used in toilet paper, paper towel, facial tissues, or similar material that can absorb moisture found on the toilet seat. Base layer 28 should be formed of a material that decomposes when flushed down the toilet. Top layer 25 and base layer 28 may be formed of multiple sub-layers provided that each layer has the specified properties: top layer 25 should be a cold-water soluble film and base layer 28 should be a material that can absorb moisture and decomposes after use.

Top layer 25 is attached to base layer 28 by a water-soluble adhesive or glue. This adhesive or glue is typically applied to substantially coat the bottom surface of the top layer 25 with base layer 28 being affixed thereto. Those of ordinary skill in the art will recognize that the order of these steps is not crucial. Indeed, top layer 25 may already contain the water-soluble adhesive on one side. Such a film is commercially available from Barnyarns (Ripon) Ltd. of the United Kingdom.

Referring to FIG. 1, in one implementation, top layer 25 overhangs or extends beyond the edge of base layer 28 on each side forming tabs or wings 24. Tabs or wings 24 include the water-soluble adhesive or glue on the bottom side that overhangs base layer 28. These tabs 24 can be stuck to the toilet seat to hold seat cover 20 in place during use and prevent it from sliding or bunching. Prior to application to the toilet seat, tabs 24 may be covered with paper similar to that of base layer 28. Perforations could be used to ease removal of the paper from tabs 24 for use.

Figure 3:
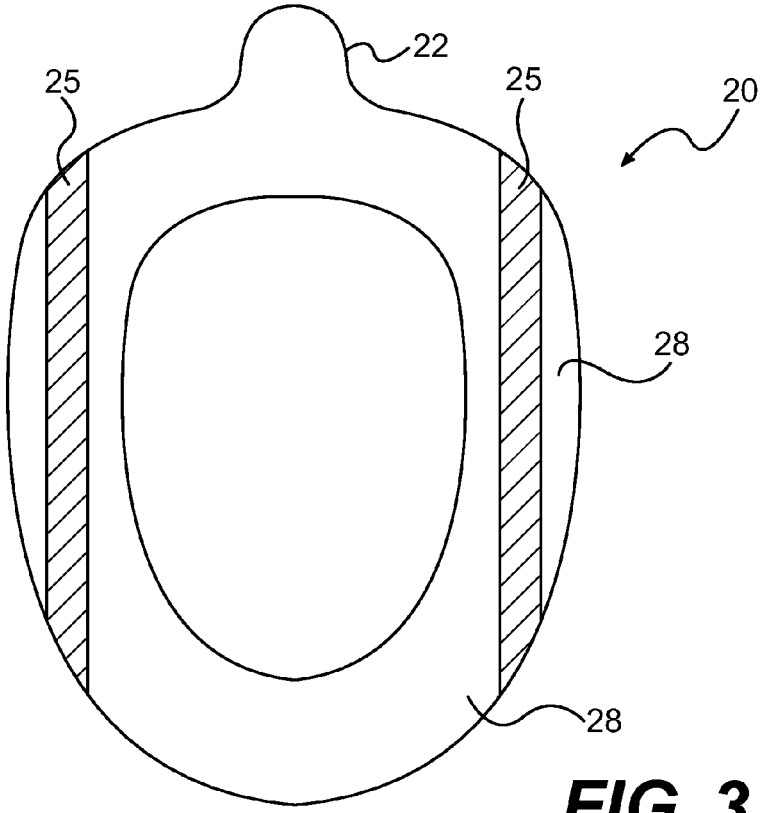
FIG. 3 is a bottom view of a toilet seat cover as shown in FIG. 1.
Figure 4:
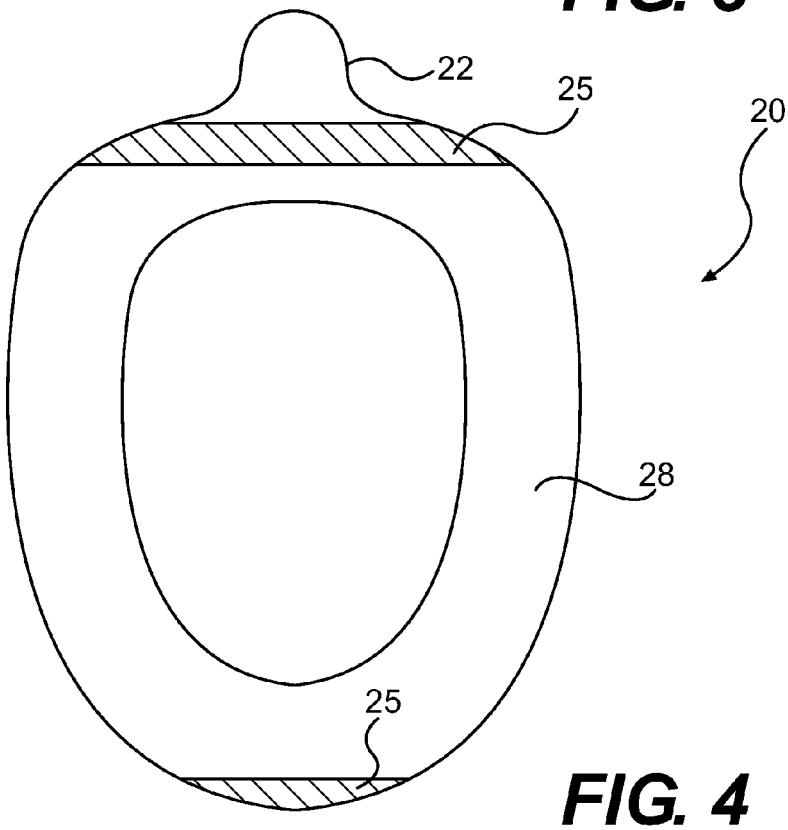
FIG. 4 is a bottom view of a toilet seat cover as shown in FIGS. 1 and 3.

While tabs or wings 24 are shown in FIG. 1, other configurations for adhering seat cover 20 to the toilet seat are also contemplated. For example, base layer 28 could include removable strips 32 that can be removed to expose portions of top layer 25 that include water-soluble adhesive or glue that can be stuck to the toilet seat. Such strips could run longitudinally along the length of seat cover 20, as shown in FIG. 3, or in a transverse direction from one side to another, as shown in FIG. 4. Although the arrangements shown in FIGS. 1, 3, and 4 would be the most common arrangements, other arrangements are also contemplated that could include a mixture of strips that could be removed from base layer 28 to expose water-soluble adhesive on top layer 25 to stick to the seat. In a particular implementation, the strips are perforated.

Figure 5:
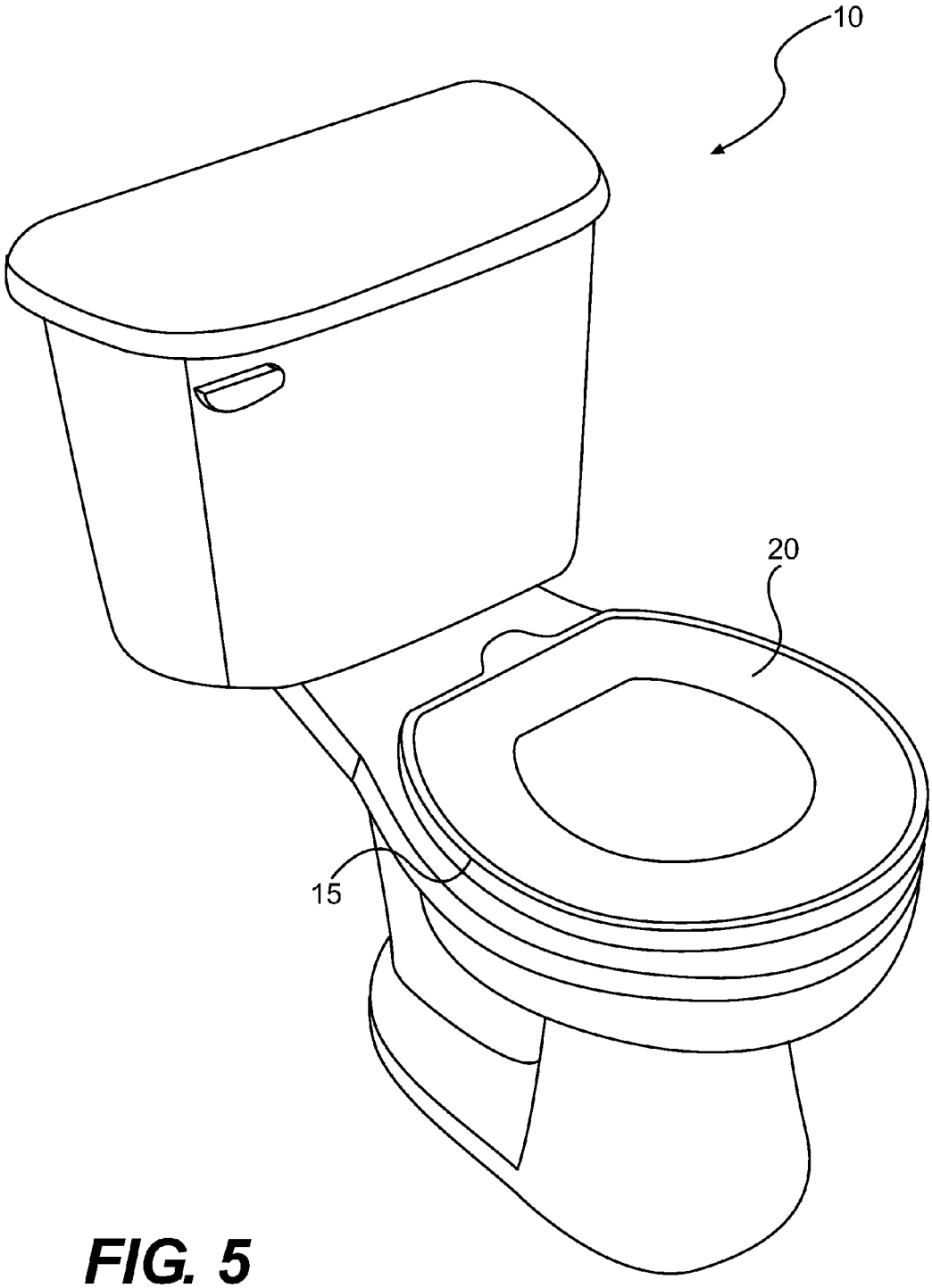
FIG. 5 is a perspective view of the toilet seat cover of FIG. 1 shown in use on a toilet.

FIG. 5 shows a toilet 10 having a toilet seat or ring 15 that includes the cover 20 according to the present invention. During use, a user would remove cover 20 from a box or dispenser. The user could remove any paper or other cover from tabs 24 and place the seat cover 20 over the toilet seat. Tabs 24 are applied to and adhere to the seat to hold cover 20 in place during use. The user then sits on the top surface of top layer 25.

Any moisture on the toilet seat is absorbed by base layer 28, while top layer 25 prevents the moisture from leaking through to the skin of the user and provides a moisture barrier between base layer 28 and the user. When finished, the user pulls or removes tabs 24 from the toilet seat and deposits cover 20 into the toilet bowl. Top layer 25 dissolves in the water leaving only base layer 28 behind. Base layer 28 can then be flushed down the toilet and decomposes with toilet paper or other tissue. Top layer 25 dissolves in water very quickly, usually within a matter of seconds. Even if top layer 25 has not fully dissolved when flushed, it will dissolve as it makes it way through the plumbing and into the sewage system. Thus, the used cover 20 may be deposited into and flushed down the toilet bowl.

EXAMPLE

The properties of the toilet seat cover that includes the base layer of toilet paper and a top layer of PVA film were tested against standard toilet paper and a toilet seat cover made from paper only.

Three spots of water that would replicate moisture found on a typical toilet seat were placed on a surface. Red water color was added to each spot to aid visibility of the water during the test. Standard toilet paper that one might find near a toilet was placed on the first spot. A piece of paper from a typical toilet seat cover was placed on the second spot. A piece of a toilet seat cover that includes a base layer of toilet paper and a top layer of PVA film was placed on the third spot. A small weight was placed over each spot to simulate the weight of an individual seated on a toilet seat.

After a few minutes, the weight was removed from each spot. The toilet paper from the first spot, the paper toilet seat cover from the second spot, and the toilet seat cover made of toilet paper and PVA film from the third spot were examined to observe the moisture penetration of each. Red coloring had soaked through the toilet paper and paper toilet seat cover from the first two spots. This means that the moisture from the toilet seat would soak through to the user. By contrast, the moisture with red coloring had not penetrated the PVA film layer of the multi-layer toilet seat cover. The toilet paper layer had absorbed the moisture and the PVA film layer had formed a barrier. In this case, a user would remain dry.

The toilet seat cover with the PVA film was then placed in cold water such as in a typical toilet. The PVA film layer dissolved in a matter of seconds leaving only the toilet paper layer. The toilet paper could then be flushed.

While the invention has been described in conjunction with specific exemplary implementations, it is evident to those skilled in the art that many alternatives, modifications, and variations will be apparent in light of the foregoing description. Accordingly, the invention is intended to embrace all such alternatives, modifications, and variations that fall within the scope and spirit of the appended claims.

What is claimed is:

1. A toilet seat cover comprising:

a top layer formed of a cold water soluble film and having a top surface and a bottom surface;

a water-soluble adhesive substantially coating the bottom surface of the top layer; and a base layer formed of biodegradable paper and attached to the bottom surface of the top layer by the water-soluble adhesive, such that, after use, the top layer substantially coated with the water-soluble adhesive dissolves in water when placed in a toilet bowl, and the base layer decomposes with toilet paper or other tissue placed into the toilet bowl.

2. The toilet seat cover of claim 1, wherein the top layer comprises tabs that, in use, removably adhere to a toilet seat.

3. The toilet seat cover of claim 1, wherein the biodegradable paper is tissue paper.

4. The toilet seat cover of claim 1, wherein the cold water soluble film includes polyvinyl alcohol.

5. The toilet seat cover of claim 1, such that when placed on a toilet seat the base layer absorbs moisture from the toilet seat.

6. The toilet seat cover of claim 5, such that when placed on a toilet seat, the top layer provides a barrier to moisture from the base layer.

7. A disposable toilet seat cover for use on a toilet seat, the toilet seat cover comprising:

a base layer formed of biodegradable tissue paper configured to cover the toilet seat and to absorb any moisture on the toilet seat, the base layer having an outer edge; and a top layer that includes a film formed of water-soluble polyvinyl alcohol and having a top surface that is configured for a user to sit thereon, and a bottom surface that is substantially coated with a water-soluble adhesive, the top layer is configured to cover the base layer to provide a moisture barrier between the base layer and the user, the top layer also includes one or more tabs that extend beyond the outer edge of the base layer, such that, in use, the tabs removably adhere to the toilet seat, such that, after use, the top layer coated with the water-soluble adhesive dissolves in water when placed in a toilet bowl, and the base layer decomposes with toilet paper or other tissue placed into the toilet bowl.

8. The toilet seat cover of claim 7, wherein the base layer is formed of toilet paper.

9. A disposable toilet seat cover for use on a toilet seat, the toilet seat cover comprising:

a layer of water-dissolving self-adhesive polyvinyl alcohol film that includes a self-adhesive on one side for removably attaching the toilet seat cover to the toilet seat; and a base layer of toilet paper attached to and substantially covered by the self-adhesive polyvinyl alcohol film, the base layer configured to cover the toilet seat and to absorb any moisture on the toilet seat, such that, after use, the layer of water-dissolving self-adhesive polyvinyl alcohol dissolves in water when placed in a toilet bowl, and the base layer decomposes with toilet paper and other tissue placed into the toilet bowl.

10. The disposable toilet seat cover of claim 9, wherein a portion of the base layer is removable to expose a portion of the self-adhesive polyvinyl alcohol film to attach the film to the toilet seat.

11. The disposable toilet seat cover of claim 10, wherein the removable portion of the base layer is perforated.

12. A method of using the disposable toilet seat cover of claim 9 on a toilet having a bowl, the method comprising:

applying the self-adhesive tabs to the toilet seat;

removing the self-adhesive tabs from the toilet seat;

placing the disposable toilet seat cover into the toilet bowl; and flushing the disposable toilet seat cover down the toilet.

13. The disposable toilet seat cover of claim 1, wherein the top layer includes a water soluble fabric.

14. The disposable toilet seat cover of claim 1, wherein the base layer includes an edge and the top layer extends beyond or overhangs the edge of the base layer.

* * * * *